US006660157B2

(12) United States Patent
Que et al.

(10) Patent No.: US 6,660,157 B2
(45) Date of Patent: Dec. 9, 2003

(54) HEAVY OIL HYDROCRACKING PROCESS WITH MULTIMETALLIC LIQUID CATALYST IN SLURRY BED

(75) Inventors: Guohe Que, Dongying (CN); Cungui Men, Dongying (CN); Chunxu Meng, Dongying (CN); An Ma, Dongying (CN); Jiashun Zhou, Dongying (CN); Wenan Deng, Dongying (CN); Zongxian Wang, Dongying (CN); Baoquan Mu, Dongying (CN); Chenguang Liu, Dongying (CN); Dong Liu, Dongying (CN); Shichang Liang, Dongying (CN); Bin Shi, Dongying (CN)

(73) Assignees: PetroChina Company Limited, Beijing (CN); University of Petroleum, Dongying (CN)

( * ) Notice: Subject to any disclaimer, the term of this patent is extended or adjusted under 35 U.S.C. 154(b) by 96 days.

(21) Appl. No.: 10/004,119

(22) Filed: Nov. 2, 2001

(65) Prior Publication Data

US 2002/0125172 A1 Sep. 12, 2002

(30) Foreign Application Priority Data

Nov. 2, 2000 (CN) ..... 0123992 U

(51) Int. Cl.[7] ..... C10G 47/02

(52) U.S. Cl. ..... 208/108; 208/111.05; 208/111.3; 208/111.35; 208/112

(58) Field of Search ..... 208/108, 111.05, 208/111.3, 111.35, 112

(56) References Cited

U.S. PATENT DOCUMENTS 4,176,051 A * 11/1979 Ternan et al. ..... 208/112
6,139,723 A * 10/2000 Pelrine et al. ..... 208/422

* cited by examiner

*Primary Examiner*—Walter D. Griffin
*Assistant Examiner*—James Arnold, Jr.
(74) *Attorney, Agent, or Firm*—David Silverstein; Andover-IP-Law

(57) ABSTRACT

The invention relates to a new and improved heavy oil hydrocracking process using a multimetallic liquid catalyst in a slurry-bed reactor, particularly an improvement of lightweight treatment of heavy oil in the petroleum processing technology. According to the present invention, a slurry-bed hydrocracking reactor and a highly dispersed multimetallic liquid catalyst are mainly applied during the process. A fixed-bed hydrotreating reactor is also used on line to enhance lightweight oil yield from heavy oil under normal pressure.

13 Claims, 1 Drawing Sheet

HEAVY OIL HYDROCRACKING PROCESS WITH MULTIMETALLIC LIQUID CATALYST IN SLURRY BED

FIELD OF THE INVENTION

Figure 1:
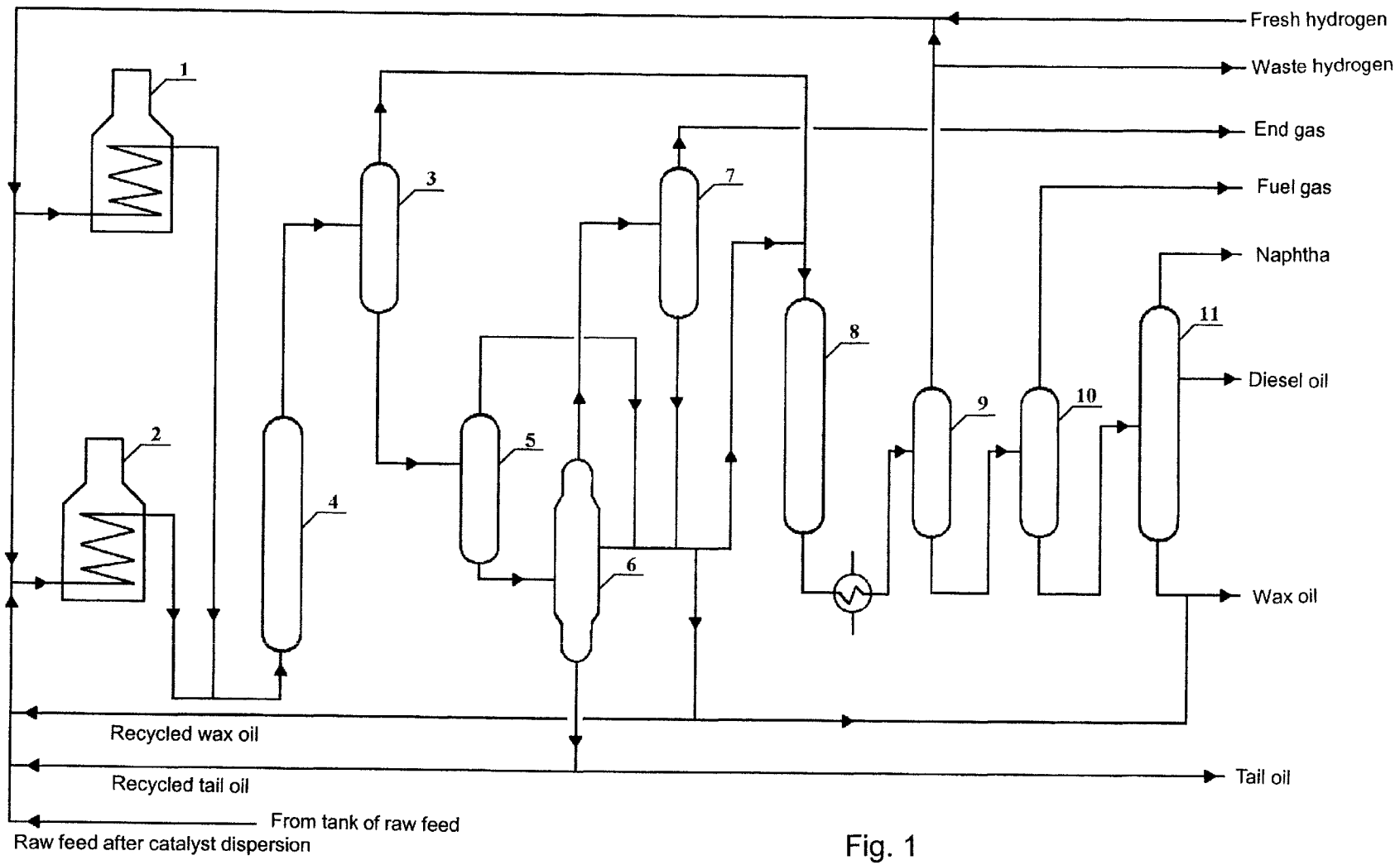

This invention relates to a new heavy oil hydrocracking process using a multimetallic liquid catalyst in a slurry-bed, particularly an improvement of lightweight treatment of heavy oil in the petroleum processing technology. According to the present invention, a slurry-bed hydrocracking reactor and the highly dispersed multimetallic liquid catalyst are mainly applied during the process. A fixed-bed hydrotreating reactor is also used on line to enhance lightweight oil yield from heavy oil under normal pressure.

BACKGROUND OF THE INVENTION

In today's world, research on slurry-bed hydrocracking processes are very active. There are now more than ten such technologies that are in pilot test stage. Some of them have already had industrialized application. But, in these technologies, there exist numerous limitations and shortcomings. The following are some examples.

One example is the VEBA-Combi-Cracking (VCC) process developed in Germany. This process adopts red mud, i.e., a kind of solid material with iron content, and the fine coke powder of Bovey coal as a catalyst. In this technology, not only is the reaction pressure (30–75 Mpa) relatively high, but also a relatively large amount of catalyst, such as about 5% weight percent of raw materials, must be used.

A second example is the Micro-Cat technology developed by ExxonMobil. In this technology, phospho-molybdic acid and molybdenum naphthenate are used as catalyst. Although the dispersion rate and activity of the catalyst are high, this technology remains for now in an experimental scale (1 drum/day). A reason may be that the cost of catalyst is relatively high with low economic profit.

A third example is the HDH technology developed by the Venezuelan INTEVEP Company. This technology uses as a catalyst a kind of inexpensive natural ore that is a special local product currently in Venezuela after it is crushed and fined. Although the catalyst is inexpensive, it must be used in a very large amount (2–3 m %). The required separation system for solid matter of catalyst and non-converted bottom oil is relatively complex. Furthermore, the mineral ore is produced specially only in Venezuela.

Still another example is the Canadian CANMET process. The catalyst used in this process is $FeSO_4 \cdot H_2O$ with a relatively high dosage (1–5%). The desulfuration and denitrogenation rate of this process is not high, although it does appear to achieve the expected quality of products. There also exist some problems in the separation of catalyst and non-converted bottom oil.

A fifth example is the SOC technology developed by a Japanese company, Ashi Kasei Industrial Co. In this technology, the catalyst, consisting of highly dispersed superfine powder and transition metallic compound, is used with high reaction activity and good anticoking effects. But, this process requires a high reaction pressure (20–22 Mpa) and a relatively high investment cost in the facility.

There are other technologies currently available around the world, such as the Aurabon technology developed by the American UOP Company, the HC3 technology developed by Canada, etc. But, some of these technologies are only being tested on an experimental scale, some use too great a dosage of catalyst, some adopt a solid catalyst, and some use expensive catalysts or require high reaction pressures. In these prior processes, the catalyst used is a single catalyst or a mixture of catalysts. Most of the raw materials being processed using the above-discussed technologies were high sulfur-containing heavy oil. The applications of these prior technologies were also limited in processing low sulfur-containing heavy oil.

SUMMARY OF THE INVENTION

In order to avoid the shortcomings of the prior processes, the object of the present invention is to provide a new and improved heavy oil hydrocracking process using a multimetallic liquid catalyst in the slurry-bed.

In order to carry out the aims of this invention, the technical embodiment of this invention can be realized through the following methods:

According to the present invention, a heavy oil hydrocracking process using a multimetallic liquid catalyst in a slurry-bed reactor under normal (atmospheric) pressure is provided. A slurry-bed hydrocracking reactor charged with a multimetallic liquid catalyst and an online fixed-bed hydrotreating reactor are installed. An online mixer is used to make full mixture of feed oil with catalyst, followed by low-temperature sulfidation. The effluent out of the reactors is separated under a high-pressure or low-pressure separating system or using a conventional separating system. Vacuum gas oil is separated and recycled.

Particularly, the present invention provides a heavy oil hydrocracking process using multimetallic liquid catalyst in the slurry-bed reactor under normal pressure conditions. The feeds, namely heavy oil mixed with catalyst and hydrogen, come into the bottom of a slurry bed hydrocracking reactor. The effluent out of the top of the reactor enters a high-temperature and high-pressure separation system whereby the effluent is separated into vapor flow and liquid flow. Vapor flow enters an online fixed-bed hydrotreating reactor, while liquid flow enters a low-pressure separation system. The vapor flow out of the top of the low-pressure separation system is also directed into the online fixed bed hydrotreating reactor after being cooled. The effluent out of the fixed bed hydrotreating reactor is fed into a conventional separation system, such as vacuum distillation tower.

The high-pressure separation system of the present invention preferably includes a hot high-pressure separator and a cold high-pressure separator. The low-pressure separation system used in the present invention preferably includes a flash drum, a vacuum distillation tower, a low-pressure separator, and a cold low-pressure separator The vacuum gas oil fractionated out of the vacuum distillation tower is returned, at least partially, to a slurry-bed hydrocracking reactor for further treatment.

The fixed-bed hydrotreating reactor is on line in the process of this invention. The hydrogen source comes from hot material flow of the slurry-bed hydrocracking reactor. The online mixer for mixing raw materials and catalyst is preferably a shear pump or a static mixer. In a particularly preferred embodiment, the shear pump is a shear pump with 2–7 levels.

A first portion of the vacuum gas oil fractionated out of the vacuum distillation tower in the low-pressure separation system is returned to the slurry-bed hydrocracking reactor. The other portion is returned to the slurry-bed hydrocracking reactor together with the slurry to enhance the yield of diesel oil.

According to the present invention, the hydrocracking reactor is a total feedback mixed reactor, and the slurry in the reactor is cycled continuously from a circulating pump to maintain a total feedback mixed state. The slurry typically comprises untreated residual oil, liquid catalyst, recycled bottoms, recycled vacuum gas oil and fresh hydrogen.

In carrying out the process of the present invention, the preferred reaction conditions of the slurry-bed hydrocracking reactor are about as follows:

reaction pressure: 8–12 Mpa,
reaction temperature: 420–460° C.,
total volume hourly space velocity: 0.8–1.4 $h^{-1}$,
recycling ratio of bottom oil/fresh raw materials: 0.3–0.8,
dosage of catalyst based on metal: 50–2000 ppm,
ratio of hydrogen to fresh raw materials: 600–1000.

The preferred conditions of the online fixed-bed hydrotreating reactor are about as follows:

reaction temperature: 300–400° C.,
reaction pressure : a little less than the pressure of the hydrocracking reactor of suspension bed,
volume hourly space velocity: 1.0–2.0 $h^{-1}$, and,
ratio of hydrogen/oil: 300–1000.

In other words, the process of the present invention includes many technical innovations to provide a completely new and improved slurry-bed hydrocracking technology. The present invention uses a highly dispersed multimetallic liquid catalyst in a slurry-bed hydrocracking reactor, and it adopts on line a fixed-bed hydrotreating reactor so that the technology can solve persistent problems of processing residual oil including low sulfur petroleum as well as high sulfur petroleum. The process of this invention is especially effective to process at normal pressures residual oil having relatively high content of nitrogen and/or metal, a relatively high viscosity, a high acid number and/or a high residual coke content. The process of this invention is further characterized in adopting a slurry-bed hydrocracking reactor charged with multimetallic liquid catalyst and an online fixed-bed hydrotreating reactor. The process of this invention also uses an online mixer to effect thorough mixing and low-temperature sulfuration of the raw materials and catalyst The process of this invention is further characterized in adopting a high and low-pressure separation system and a conventional separation system for treating the effluent out of the reactor. The process of this invention also adopts the recycle technology for processing the vacuum gas oil. In the present process, the fully mixed and heated slurry is flowed into the bottom of a slurry-bed hydrocracking reactor, while the effluent flowing out of the top of the reactor is fed to a high-temperature and high-pressure separation system, where the effluent is separated after it enters the hot high-pressure separation reactor. The material flow in the vapor phase is fed into an online fixed-bed hydrotreating reactor, while the material flow in the liquid phase is fed to a low-pressure separation system. The material flow in liquid phase coming from the low-pressure separation system (excluding the bottom oil) is also fed into the online fixed-bed hydrotreating reactor. Then, the material flow, after being hydrogenated and treated through the fixed bed, is fed to the conventional separation system for separating into a variety of products. The high-pressure separation system preferably includes a hot high-pressure separator and a cold high-pressure separator. The low-pressure separation system preferably includes a flash drum, a vacuum distillation tower, a low-pressure separator, and a cold low-pressure separator. The conventional separation system preferably includes a vacuum distillation tower. The vacuum gas oil fractionated out of the vacuum distillation tower is at least partially returned to the slurry-bed hydrocracking reactor for further treatment.

In order to achieve the above-mentioned aims, the process of this invention was designed such that the fixed-bed hydrotreating reactor would be used throughout the processing. The preferred used hydrogen source for the present invention comes from hot material flow of the slurry-bed hydrocracking reactor. The mixer for mixing raw materials and catalyst is preferably a multistage shear pump or a static mixer. The multistage shear pump may advantageously be a shear pump with 2–7 levels. A first part of the vacuum gas oil fractionated out of the vacuum distillation tower in the low-pressure separation system is preferably returned to the slurry-bed hydrocracking reactor. The other part preferably is returned to the slurry-bed hydrocracking reactor together with the fresh feed. The slurry in the slurry reactor is recycled continuously from a recirculating pump to maintain a total feedback mixed state. The slurry may typically contain untreated residual oil, liquid catalyst, recycled bottoms, recycled vacuum gas oil and fresh hydrogen.

In the present invention, the reaction conditions of the slurry-bed hydrocracking reactor are preferably as follows: the reaction pressure is about 8–12 Mpa; the reaction temperature ranges from about 420–460° C.; the total volume hourly space velocity is about 0.8–1.4 $h^{-1}$; the recycling ratio of bottom oil over fresh feed oil is about 0.3–0.8; the dosage of catalyst used relative to total weight of metal is about 50–2000 ppm; and the ratio of hydrogen to fresh feed oil is about 600–1000. The conditions of the online fixed-bed hydrocracking reactor are preferably as follows: the reaction temperature is about 300–400° C.; the pressure is preferably just a little below the pressure of the slurry-bed hydrocracking reactor; the volume hourly space velocity is about 1.0–2.0 $h^{-1}$; and the ratio of hydrogen over feed oil is about 300–1000. The catalyst used by the slurry-bed hydrocracking reactor is preferably a highly dispersed multimetallic liquid catalyst. The principal components of the multimetallic liquid catalysts according to the present invention are the multimetallic salts. The catalyst used in the fixed-bed hydrotreating reactor may be catalyst 3936 or RN-2 hydrocracking catalyst, or similar catalysts as are commonly used in the industry.

There are numerous differences between the hydrocracking technology of the present invention and the several hydrocracking technologies of the prior art processes. Some of those key differences include the following:

(1) The slurry-bed hydrocracking reactor in the present invention applies highly dispersed (micron or nm) multimetallic liquid catalyst. The effective metal components of the catalyst include nickel, iron, molybdenum, manganese, cobalt and the like. Because a major part of the metal components of the catalyst is recovered from the industrial waste materials, the cost is thereby greatly reduced. The multimetallic liquid catalysts of the present invention differ fundamentally from the solid powder catalysts or the dispersed catalysts with small amounts of other components which are commonly used in the world.

(2) Another feature of the present invention is the adoption of a novel catalyst dispersion and low-temperature sulfuration technology. In the present invention, a 2–4 level shear pump is preferably used in the flow pipeline for raw oil and catalyst which are thereby dispersed and mixed at about 2000–5000 turns/m. Thereafter, the sulfuration of catalyst in the mixed materials is completed using gas containing hydrogen sulfide at the temperature of about 100–180° C.

(3) In still another difference from the prior processes, the present invention adopts a circulating cracking route with vacuum gas oil and bottom oil. The main products of the process are naphtha and diesel oil as well as a small amount of bottom oil.

(4) As the present invention adopts a total return mixed cracking reactor, only a relatively small amount of coke formation results. The temperature of the reactor is very even and easy to control so that it simplifies the reactor operation and temperature control. Additionally, this invention adopts a high-temperature, high-pressure online hydrotreating reactor that not only efficiently makes full use of existing reaction temperature and pressure, but also makes products of very high quality.

In comparison with the prior processes, the present invention has the following additional advantages:

(1) The multimetallic liquid catalyst used in the process of the present invention is highly dispersed resulting in surprisingly improved performance. The particle size of the catalyst is small (on the order of about 0.1–5 micron) with high activity, therefore only a very small dosage (>0.1%) is needed. In addition, as many metal components in the catalyst come from industrial waste materials, the cost of this catalyst is very low.

(2) Due to the high activity of the multimetallic liquid catalyst of the present invention, the reaction temperature is relatively high (e.g., about 430–460° C.) with a high cracking conversion rate (80–90%) and with little coking formation (<1%).

(3) Low reaction pressure can be used, (e.g., hydrogen partial pressure of reaction of about 8–12.0 Mpa). The industrial process is simple and, for example, only 1–2 reactors need to be used in the process, thereby resulting in low capital costs for construction of facilities to carry out the process of this invention.

(4) As the present invention utilizes a total return mixed cracking reactor in combination with a vacuum gas oil circulating cracking and high-temperature, high-pressure online treating reactor, it avoids the need to build more hydrotreating and vacuum gas oil hydrocracking cracking facilities. It also results in products of high quality. After separating the product into components, the naphtha recovered can be used as reforming stock and for cracking materials, and the diesel oil is sweet oil on average having a hexadecane number with low-nitrogen content and of high quality.

Because vacuum gas oil or bottom oil circulation is adopted as a feature of this invention, it increases the flexibility of the operation of the facility. The present process is preferably applied to mainly produce naphtha and diesel oil. If necessary, however, it can also be slightly modified to produce high quality vacuum gas oil.

The process of the present invention can play a specific role. It can realize a very high recovery rate. It has very advantageous benefits in processing all kinds of heavy oils, including those of low quality, as well as viscous crude, including normal pressure residual oil and very viscous ones. It is especially effective in processing petroleum residual oil with high nitrogen content, high metal content, high viscosity, having a high acid number and having high residual coke, still realizing conversion rates of more than 80–95%. Thus, the process of this invention truly has a wide-range of industrial applications.

DETAILED DESCRIPTION OF THE DRAWING

FIG. 1 shows a schematic process flow chart of the present process, wherein the reference numerals in the appended drawing are described as follows:

1 indicates a hydrogen heating furnace.
2 indicates an oil heating furnace.
3 indicates a hot high-pressure separator.
4 indicates a slurry-bed hydrocracking reactor.
5 indicates a flash drum.
6 indicates a vacuum distillation tower.
7 indicates a separator.
8 indicates a fixed-bed hydrotreating reactor.
9 indicates a cold high-pressure separator.
10 indicates a cold low-pressure separator.
11 indicates an atmospheric vacuum distillation tower.

DETAILED DESCRIPTION OF THE PREFERRED EMBODIMENTS

In the actual operation of the present invention as indicated in FIG. 1, a highly dispersed multimetallic catalyst (UPC series) is used in a slurry-bed hydrocracking reactor. Catalyst No. 3936 or RN-2 hydrotreating catalyst is used in the hydrotreating reactor having a fixed bed. A residual oil of raw materials containing a highly dispersed multimetallic catalyst and a little curing agent is mixed with vacuum gas oil or bottom oil and pumped to the residual oil heating furnace 2. After being heated to about 380–480° C., the residual oil is mixed again with the hydrogen coming out of the hydrogen heating furnace 1 and having a corresponding temperature. This first mixed stream is then fed into the slurry-bed hydrocracking reactor 4. The effluent out of the hydrocracking reactor 4 is flashed and distilled into gas and liquid phases in a hot high-pressure separator 3. The material flow in the gas phase, including mixed hydrogen, is fed online directly into fixed-bed hydrotreating reactor 8 from the top of separator 3. The liquid flow (i.e., black oil with catalyst) coming out of the bottom of separator 3 is fed into a flash drum 5 to be flash distilled after it is decompressed. The material flow out of the top of the flash drum 5, together with the sidedraw material flow out of vacuum distillation tower 6, and also together with the material flow out of the bottom of separator 7, are joined with each other to form a second mixed stream. At least a portion of this second mixed stream may be sent to reactor 8 for hydrotreating, or a portion may be remixed with the oil out of the bottom of vacuum distillation tower 11 which is used as exit equipment for processing vacuum gas oil. Alternatively, this second mixed stream could also be mixed with the recycled bottoms, then sent to the slurry bed hydrocracking reactor 4 via heating furnace 2. The liquid flow out of the bottom of the flash drum 5 is sent to a vacuum distillation tower 6. A part of the bottom oil in the bottoms stream from the vacuum distillation tower 6 is withdrawn from the system while another part is recirculated as bottom oil. The material flow out of the top of the vacuum distillation tower 6 is sent to a separator 7. The gas phase from the top of the separator 7 is withdrawn from the system as end gas. The reaction product and hydrogen coming from the fixed-bed online hydrotreating reactor 8 is sent into a cold high-pressure separator 9 to effect separation of oil, gas and water after being heat-exchanged and cooled down and being water-flooded whereby ammonium salt is generated after the dissolution step. Sulfur-containing wastewater with dissolved $NH_3$ and $H_2S$ is withdrawn from cold high-pressure separator 9 and is sent together with the combination of sulfur-containing wastewater coming from the cold low-pressure separator 10 to be processed jointly. The flashed gas from the cold high-pressure separator had a high content of hydrogen. Most of that hydrogen is returned to the reaction system as recycled hydrogen after being boosted in pressure by a recycled hydrogen compressor and mixed with fresh hydrogen. In order to maintain the needed concentration of recycled hydrogen to meet system requirements, it may be necessary to blow off a small amount of gas from the cold high-pressure separator as a waste hydrogen gas stream. In order to minimize hydrogen loss, a membrane separator may be used to recover some of the hydrogen from this waste hydrogen stream. The end gas released by the membrane separator is sent off to be desulfated. The oil flow through the cold high-pressure separator 9 and cold low-pressure separator 10 is sent to atmospheric vacuum distillation tower 11 after being heat exchanged and heated. A mixed naphtha stream is then recovered from the top of the vacuum distillation tower 11, a diesel oil product is obtained as a sidedraw from tower 11, and bottom oil out of the bottom of the vacuum distillation tower 11 is mixed with decompressed vacuum gas oil taken as a sidedraw from vacuum distillation tower 6 to form raw materials for the catalytic cracking equipment.

EXAMPLE

In the following example, Karamay atmospheric residue was used in connection with carrying out a hydrocracking process in accordance with this invention. The reaction temperature of the Karamay atmospheric residue in the 30–100 ton/year medium-size facility was 400–480° C. The hydrogen partial pressure was 4–12 Mpa. Multimetallic liquid catalyst Type UPC-21 was used. The total volume hourly space velocity of raw materials was 1.0–1.3 $h^{-1}$. The volume hourly space velocity of fresh raw materials was 0.4–0.8 $h^{-1}$. The yield of this slurry-bed hydrocracking cracking process reaches up to 90–97 m % when carried out at temperatures below 524° C. The concrete data for this process is as follows.

1. Product distribution resulting from the suspension bed hydrocracking cracking of atmospheric residue from Karamay Oil field, China under different reaction temperatures (single pass yield):

| Reaction temperature, ° C. | 430 | 435 | 440 | 445 | 450 |
|---|---|---|---|---|---|
| hydrogen partial pressure, Mpa | 10.0 | 10.0 | 10.0 | 10.0 | 10.0 |
| Hydrogen-oil ratio, $Mm^3/m^3$ | 740/1 | 742/1 | 757/1 | 737/1 | 735/1 |
| Total volume volume hourly space velocity, $h^{-1}$ | 1.13 | 1.13 | 1.10 | 1.13 | 1.14 |
| Product distribution, m % | | | | | |
| C1–C4 (gas) yield | 4.63 | 4.70 | 4.76 | 4.96 | 5.03 |
| C5-180° C. (naphtha fraction) yield | 6.67 | 7.97 | 9.27 | 10.28 | 11.68 |
| 180–350° C. (diesel oil fraction) yield | 19.02 | 22.56 | 24.08 | 27.41 | 30.55 |
| 350–524° C. (vacuum gas oil fraction) yield | 39.89 | 39.51 | 37.50 | 37.62 | 35.00 |
| <524° C. yield | 70.21 | 75.13 | 75.61 | 80.27 | 82.25 |
| >524° C. (bottom oil) yield | 30.84 | 26.06 | 25.39 | 20.90 | 19.00 |
| Hydrogen loss: m % | 1.06 | 1.09 | 1.13 | 1.18 | 1.25 |
| Total yield: m % | 101.6 | 101.19 | 101.0 | 101.18 | 101.25 |

2. Product distribution resulting from the suspension bed hydrocracking of atmospheric residue from Karamay Oil Field, China under different reaction temperatures (single pass and circulating yield):

| Reaction temperature, ° C. | 440 | 440 | 445 | 445 |
|---|---|---|---|---|
| Hydrogen partial pressure, Mpa | 10.0 | 10.0 | 10.0 | 10.0 |
| Hydrogen-oil ratio, $Mm^3/m^3$ | 757/1 | 800/1 | 737/1 | 800/1 |
| Recycling ratio (fresh raw material/bottom oil) | 100 | 66/34 | 100 | 70/30 |
| Total volume volume hourly space velocity, 1/h | 1.10 | 1.14 | 1.13 | 1.14 |
| Volume volume hourly space velocity of fresh raw material, $h^{-1}$ | 1.10 | 0.75 | 1.13 | 0.80 |
| Product distribution, m % | | | | |
| C1–C4 (gas) yield | 4.76 | 5.50 | 4.96 | 7.40 |
| C5-180° C. (naphtha fraction) yield | 9.27 | 9.60 | 10.28 | 13.80 |
| 180–350° C. (diesel oil fraction) yield | 24.08 | 27.30 | 27.41 | 29.60 |
| 350–524° C. (vacuum gas oil fraction) yield | 37.50 | 53.10 | 37.62 | 45.40 |
| <524° C. yield | 75.61 | 96.30 | 80.27 | 96.20 |
| >524° C. (bottom oil) yield | 25.39 | 4.60 | 20.90 | 5.00 |
| Hydrogen loss: m % | 1.13 | 0.92 | 1.18 | 1.18 |
| Total yield: m % | 101.0 | 100.92 | 101.18 | 101.18 |

3. Composition and characteristics of the naphtha fraction (IBP-180° C.) before and after refining

| Refining condition | Before refining | After refining | After refining | After refining | After refining |
|---|---|---|---|---|---|
| Fraction components of refining raw materials, ° C. | — | IBP-350 | IBP-350 | IBP-350 | IBP-500 |
| Refining temperature, ° C. | — | 360 | 380 | 400 | 400 |
| Refining pressure, Mpa | — | 10.0 | 10.0 | 10.0 | 10.0 |
| Composition of Hydrocarbon family, m % | | | | | |
| Normal paraffin hydrocarbon | 20.61 | 24.94 | 24.97 | 25.05 | 21.30 |
| Isoalkane | 32.81 | 38.04 | 38.95 | 39.62 | 36.50 |

-continued

| Refining condition | Before refining | After refining | After refining | After refining | After refining |
|---|---|---|---|---|---|
| Naphthene hydrocarbon | 15.91 | 31.63 | 31.34 | 30.97 | 33.65 |
| aromatic hydrocarbon | 10.40 | 5.39 | 4.74 | 4.36 | 6.10 |
| olefine hydrocarbon | 20.27 | 0.0 | 0.0 | 0.0 | 0.0 |
| Potential content of aromatic hydrocarbon, m % | — | 38~42 | 38~42 | 38~42 | 38~42 |
| Octane value | 78.1 | 73.4 | 73.9 | 74.3 | 75.0 |
| Density (20° C.), g/cm$^3$ | 0.7543 | 0.7451 | 0.7454 | 0.7519 | 0.7499 |
| Sulfur, μg/g | 440 | 0.5~1.0 | 0.5~1.0 | 0.2~0.6 | 0.5~1.0 |
| Nitrogen, μg/g | 658 | 1.0~2.0 | 1.0~2.0 | 0.5~1.5 | 1.0~2.0 |
| Basic nitrogen, μg/g | 160 | <1.0 | <1.0 | <1.0 | <1.0 |

4. Composition and characteristics of the diesel oil fraction (180–350° C.) before and after refining

| Item | Before refining | After refining | After refining | After refining | After refining |
|---|---|---|---|---|---|
| Fraction components of refining raw materials, ° C. | — | IBP-350 | IBP-350 | IBP-350 | IBP-500 |
| Refining temperature, ° C. | — | 360□ | 380□ | 400□ | 400□ |
| Refining pressure, Mpa | — | 10.0 | 10.0 | 10.0 | 10.0 |
| Density (20° C.), g/cm$^3$ | 0.8464 | 0.8303 | 0.8241 | 0.8202 | 0.8449 |
| Viscosity (20° C.), mm$^2$/s | 8.79 | 3.83 | 3.47 | 3.40 | 3.97 |
| Viscosity (40° C.), mm$^2$/s | 3.16 | 2.70 | 2.33 | 2.18 | 2.58 |
| Sulfur, μg/g | 570 | 18.2 | 13.5 | 12.4 | 19.3 |
| Nitrogen, μg/g | 1510 | 5.5 | 4.3 | 4.1 | 8.9 |
| Basic nitrogen, μg/g | 780 | 5.0 | 3.9 | 3.6 | 5.9 |
| Aniline point, ° C. | 62.2 | 72.0 | 72.0 | 70.1 | 67.9 |
| Centane value | 49.6 | 58.1 | 60.3 | 62.2 | 53.1 |
| Acidity, mg KOH/100 ml | 35.62 | 3.40 | 2.41 | 2.14 | 3.45 |
| Solidifying point, ° C. | −38 | −37 | −37 | −32 | −37 |
| Cold filtering point, ° C. | <−20 | <−20 | <−20 | <−20 | <−20 |

While the invention has been described in connection with a preferred and several alternative embodiments, it will be understood that there is no intention to thereby limit the invention. On the contrary, it is intended that this invention cover all alternatives, modifications and equivalents as may be reasonably included within the spirit and scope of the invention as defined by the appended claims, which are the sole definition of the invention.

What is claimed is:

1. A heavy oil hydrocracking process using a multimetallic liquid catalyst in a suspension bed in a slurry-bed hydrocracking reactor under normal pressure and also using an online fixed-bed hydrotreating reactor, said process comprising the steps of:

(a) providing a fully mixed and heated feed of heavy oil mixed with catalyst and hydrogen to the bottom of a slurry-bed hydrocracking reactor;

(b) sending effluent out of the top of said slurry-bed reactor to a high-temperature and high-pressure separation system whereby the effluent is separated into vapor flow and liquid flow;

(c) material flow in the vapor phase coming from said high-temperature/high-pressure separation system is sent to an online fixed-bed hydrotreating reactor while material flow in the liquid phase from said high-temperature/high-pressure separation system is sent to a low-pressure separation system;

(d) material flow in the vapor phase coming from the low-pressure separation system is also directed into the online fixed-bed hydrotreating reactor;

(e) material flow into the online fixed-bed hydrotreating reactor is hydrogenated and treated;

(f) effluent from the online fixed-bed hydrotreating reactor is sent to a final product separation system comprising a vacuum distillation tower for separation and to obtain products; and, (g) vacuum gas oil fractionated out of the vacuum distillation tower is returned at least partially to the slurry-bed hydrocracking reactor to be treated.

2. A heavy oil hydrocracking process using a multimetallic liquid catalyst in suspension bed under normal pressure according to claim 1, wherein said high-temperature/high-pressure separation system includes a hot high-pressure separator and a cold high-pressure separator.

3. A heavy oil hydrocracking process using a multimetallic liquid catalyst in suspension bed under normal pressure according to claim 1, wherein said low-pressure separation system includes a flash drum, a vacuum distillation tower, a low-pressure separator, and a cold low-pressure separator.

4. A heavy oil hydrocracking process using a multimetallic liquid catalyst in suspension bed under normal pressure according to claim 1, wherein said final product separation system includes a cold high-pressure separator, a cold low-pressure separator, and a vacuum distillation tower.

5. A heavy oil hydrocracking process using a multimetallic liquid catalyst in suspension bed under normal pressure according to claim 1, wherein said fixed-bed hydrotreating reactor is on line during all process operations and further wherein the hydrogen source is hot material flow from the hydrocracking reactor.

6. A heavy oil hydrocracking process using a multimetallic liquid catalyst in suspension bed under normal pressure according to claim 1, further comprising the step of using an online mixer for mixing raw materials and catalyst.

7. A heavy oil hydrocracking process using a multimetallic liquid catalyst in suspension bed under normal pressure according to claim 6, further wherein the online mixer for mixing raw materials and catalyst is a shear pump or a static mixer.

8. A heavy oil hydrocracking process using a multimetallic liquid catalyst in suspension bed under normal pressure according to claim 7, further wherein said shear pump is a shear pump with 2–7 levels.

9. A heavy oil hydrocracking process using a multimetallic liquid catalyst in suspension bed under normal pressure according to claim 1, wherein a first part of the vacuum gas oil fractionated out of the vacuum distillation tower in the low-pressure separation system is returned to said slurry-bed hydrocracking reactor and a second part is returned to said slurry-bed hydrocracking reactor together with the slurry to enhance the yield of diesel oil.

10. A heavy oil hydrocracking process using a multirnetallic liquid catalyst in suspension bed under normal pressure according to claim 1, wherein said hydrocracking reactor is a total feedback mixed reactor wherein the slurry containing untreated residual oil, liquid catalyst, recycled bottoms, recycled vacuum gas oil and fresh hydrogen in the reactor is cycled continuously from a circulating pump to maintain a total feedback mixed state in said reactor.

11. A heavy oil hydrocracking process using a multimetallic liquid catalyst in suspension bed under normal pressure according to claim 1, wherein the reaction conditions of said hydrocracking reactor are as follows:

reaction pressure: 8–12 Mpa, reaction temperature: 420–460° C., total volume hourly space velocity: 0.8–1.4, recycling ratio of bottom oil/fresh raw materials: 0.3–0.8, dosage of catalyst based on metal: 50–2000 ppm, ratio of hydrogen to fresh raw materials: 600–1000;

and further wherein the conditions of the online fixed-bed hydrotreating reactor are as follows:

reaction temperature: 300–400° C., reaction pressure: a little less than the pressure of the slurry-bed hydrocracking reactor, volume hourly space velocity: 1.0–2.0, and, ratio of hydrogen/oil: 300–1000.

12. A heavy oil hydrocracking process using a multimetallic liquid catalyst in suspension bed under normal pressure according to claim 1, wherein the catalyst used in the hydrocracking reactor suspension bed is a highly dispersed multimetallic liquid catalyst mainly comprising multimetallic salts.

13. A heavy oil hydrocracking process using a multimetallic liquid catalyst in suspension bed under normal pressure according to claim 1, wherein the reaction conditions of said hydrocracking reactor are as follows:

reaction pressure: 8–12 Mpa, reaction temperature: 420–460° C., total volume hourly space velocity: 0.8–1.4, recycling ratio of bottom oil/fresh raw materials: 0.3–0.8, dosage of catalyst based on metal: 50–2000 ppm, ratio of hydrogen to fresh raw materials: 600–1000.

* * * * *